United States Patent [19]

Wirz

[11] Patent Number: 4,732,084

[45] Date of Patent: Mar. 22, 1988

[54] SHEET-FED ROTARY PRINTING MACHINE FOR SINGLE-SIDE MULTICOLOR PRINTING AND PERFECTOR PRINTING

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 936,968

[22] Filed: Dec. 1, 1986

Related U.S. Application Data

[63] Continuation of Ser. No. 720,637, Apr. 8, 1985, abandoned.

[30] Foreign Application Priority Data

Apr. 7, 1984 [DE] Fed. Rep. of Germany ..... 3413159

[51] Int. Cl.[4] ..... B41F 5/16

[52] U.S. Cl. ..... 101/177; 101/183; 101/230

[58] Field of Search ..... 101/136, 137, 140, 141, 101/142, 144, 145, 174, 177, 183, 184, 185, 229, 230, 231, 232, 246, 422

[56] References Cited

U.S. PATENT DOCUMENTS

| | | | |
|---|---|---|---|
| 3,161,130 | 12/1964 | Vogel | 101/422 |
| 4,018,161 | 4/1977 | Johne et al. | 101/231 |
| 4,101,122 | 7/1978 | Jeschke et al. | 101/231 X |
| 4,188,883 | 2/1980 | Schone et al. | 101/183 |
| 4,214,526 | 7/1980 | Jeschke | 101/183 |
| 4,327,135 | 4/1982 | Wirz et al. | 101/422 X |
| 4,621,576 | 11/1986 | Wirz | 101/230 |

*Primary Examiner*—Charles A. Pearson

*Attorney, Agent, or Firm*—Herbert L. Lerner; Laurence A. Greenberg

[57] ABSTRACT

A sheet-fed rotary printing machine for single-side multi-color printing or perfector printing having an in-line type of construction with at least one sheet-turning device as well as devices for processing both papers and cardboard, and respective printing units each having, in addition to a plate cylinder and a blanket cylinder of equal given diameter, an impression cylinder having a diameter at least double the given diameter and a sheet transfer drum includes a lower printing-unit part with parts of the turning device located between an adjacent pair of the printing units, the lower printing-unit part having a storage drum in place of an impression cylinder, the storage drum being formed with at least two sheet-carrying surfaces, and a sheet transfer drum with a diameter at least double the given diameter, the printing unit of the adjacent pair of printing units following the lower printing-unit part, in travel direction of a sheet through the printing machine, having a sheet transfer drum formed as a turning cylinder following the storage drum, the turning cylinder carrying at least two systems of pincer-type grippers.

3 Claims, 1 Drawing Figure

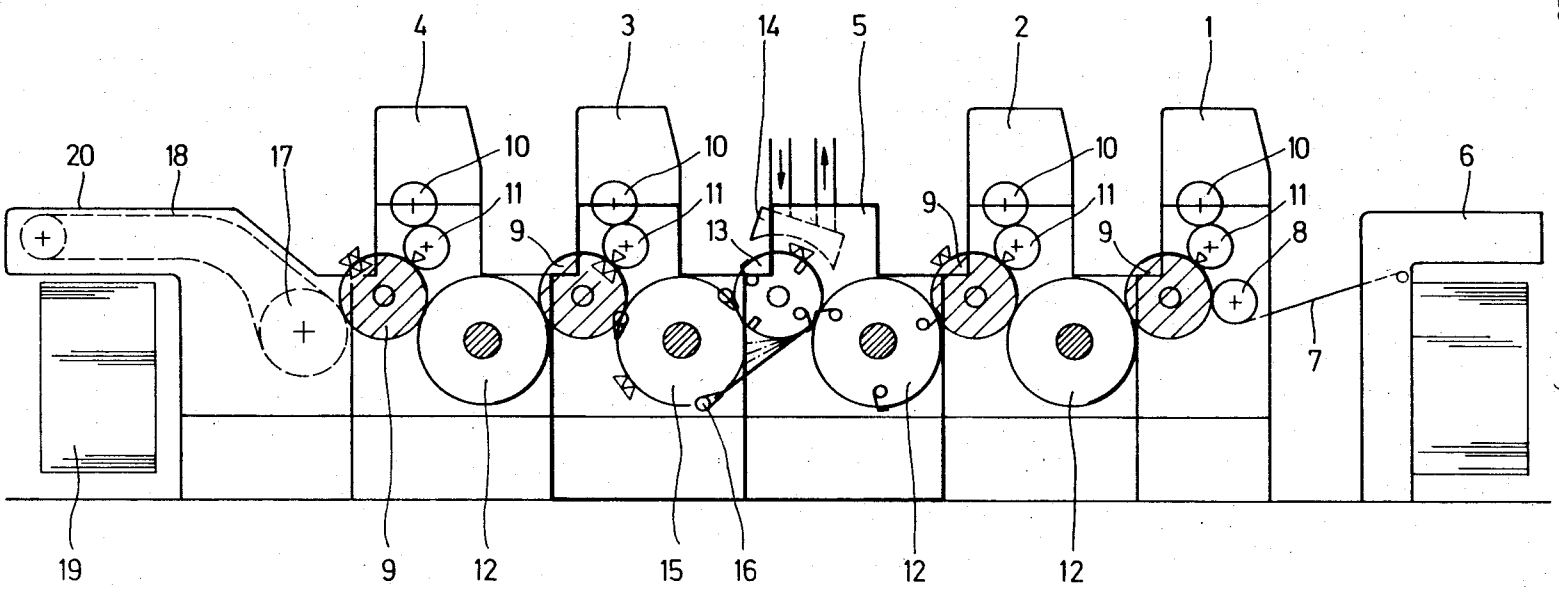
1
2
3
4
5
6
7
8
9
10
11
12
13
14
15
16
17
18
19
20

SHEET-FED ROTARY PRINTING MACHINE FOR SINGLE-SIDE MULTICOLOR PRINTING AND PERFECTOR PRINTING

This application is a continuation of application Ser. No. 720,637, filed Apr. 8, 1985, now abandoned.

The invention relates to a sheet-fed rotary printing machine for single-side multicolor printing or perfector printing having an in-line type of construction with at least one sheet-turning device as well as devices for processing both paper as well as cardboard, and respective printing units each having in addition to a plate cylinder and a rubber-covered or blanket cylinder of equal given diameter, an impression cylinder having a diameter at least double the given diameter, as well as a sheet transfer drum.

A multicolor sheet-fed rotary printing press of the foregoing general type has become known heretofore from German Published Non-Prosecuted Application (DE-OS) No. 24 52 167. The impression cylinder of each printing unit of this printing machine and the turning cylinder, which is disposed between two printing units, have diameters which are double the diameter of the plate cylinder or blanket cylinder of the printing units. At the tangent point between the impression and turning cylinders, a suction system provided on the turning cylinder grips the trailing edge of the freshly printed sheet which is lying on the smooth sheet-guiding surface of the impression cylinder. After swinging within the circumference or periphery of the turning cylinder, the suction system transfers the gripped trailing edge of the sheet to a gripper system which then swings out again during a further rotational movement of the turning cylinder and transfers the sheet with the trailing edge first to the gripper system of the succeeding impression cylinder. To achieve an in-register sheet transfer, the suction system is constructed as part of a connecting rod or couple of a double rocker or compensating lever.

Due to the relatively large diameters of the sheet-carrying cylinders, the heretofore known multicolor sheet-fed rotary printing machine is basically suitable for processing cardboard. Because the removal of the leading edge of the sheet from the smooth back-pressure or impression surface of the impression cylinder must take place by means of a suction system, it is inevitable, despite the use of a double rocker, that a rear or trailing section of the sheet will be bent during transfer of the trailing edge of the sheet to the gripper system of the turning cylinder. A consequence thereof is that the processing of thick cardboard is possible, if at all, only within very low speed ranges. Due to the stiffness of the carboard, the aforementioned bending of the trailing edge of the sheet causes the sheet to break away from the suction system particularly at high printing-machine speeds. In addition, with such a turning system, print-free areas for proofing segments must be provided.

Furthermore, German Published Prosecuted Application (DE-AS) No. 2 305 132 discloses a sheet-turning device for in-line rotary printing presses in which the impression cylinders of consecutive printing units are connected by a single sheet transfer drum. To turn the sheet, two pairs of gripper systems respectively formed of two cooperating rows of clamp-type grippers are disposed in the impression cylinder which follows the sheet transfer drum in the direction of travel of the sheet being printed. The impression cylinder and the sheet transfer drum are double the diameter of the plate or the blanket cylinder of the respective printing units. Provided above the sheet transfer drum are suction boxes which lift the sheet to be turned slightly off the outer cylindrical surface of the sheet transfer drum the instant a row of clamp-type grippers disposed on the following impression cylinder has gripped the trailing edge of the sheet. During the turning process i.e. during the transfer of the trailing edge of the sheet from the one gripper system to the other, the sheet is tightly held by the suction boxes. The suction boxes, in fact, apply suction to the non-printed side of the sheet; however, the instant the gripper systems of the impression cylinder, after the turning operation, pull the then trailing sheet edge away from the last suction box, the printed underside of the sheet can impact either with the surface of the sheet transfer drum or with the outer cylindrical surface of the impression cylinder then transporting the sheet, whereby smearing of the printed image is unable to be avoided. This disadvantage notwithstanding, it is scarcely possible for the trailing edge of the sheet to be transferred without bending by the two rows of grippers which come into action when the sheet is being turned. As a result, a very thick cardboard would receive permanent deformations therein which are unacceptable. Moreover, bent-up cardboard edges cause operational malfunctions because they impact with the following gripper edges and prevent the cardboard from being correctly gripped.

Finally, German Published Non-Prosecuted Application (DE-OS) No. 26 39 900 discloses a sheet-fed rotary printing machine of unit or set construction type with a device for selective or optional single-side printing and perfector printing in which, disposed between identical printing units is a modular-type independent unit or set having a transfer cylinder and a following turning drum of the afore-mentioned type. The transfer cylinder cooperates with one or two drying devices. This set or component has a disadvantage in that the side walls thereof are not identical with those of the lower printing-unit parts. The set or component thus requires special manufacture. Furthermore, the sheet is also quite obviously sucked from the transfer cylinder by the gripper devices of the turning drum and transferred to further gripper devices for the purpose of turning it. As explained hereinbefore, it is not possible to prevent stiff cardboard edges from being bent. Furthermore, there is a danger of the cardboard breaking away from the suction systems.

It is accordingly an object of the invention to provide a convertible high-performance sheet-fed offset printing machine of the type mentioned in the introduction hereto which will afford smear-free processing of paper up to thick cardboard while using tried-and-tested components which are also used in other printing units.

With the foregoing and other objects in view, there is provided, in accordance with the invention, a sheet-fed rotary printing machine for single-side multicolor printing or perfector printing having an in-line type of construction with at least one sheet-turning device as well as devices for processing both paper and cardboard, and respective printing units each having, in addition to a plate cylinder and a blanket cylinder of equal given diameter, an impression cylinder having a diameter at least double the given diameter and a sheet transfer drum, comprising a lower printing-unit part with parts of the turning device located between an adjacent pair of the printing units, the lower printing-unit part having a storage drum in place of an impression cylinder, the storage drum being formed with at least two sheet-carrying surfaces, and a sheet transfer drum with a diameter at least double the given diameter, the printing unit of the adjacent pair of printing units following the lower printing-unit part, in travel direction of a sheet through the printing machine, having a sheet transfer drum formed as a turning cylinder following the storage drum, the turning cylinder carrying at least two systems of pincer-type grippers. The lower printing-unit part constituting a turning apparatus, in the case of multicolor printing machines, can be provided at any location between two adjacent printing units. The respectively following printing unit need then merely be provided with a turning cylinder instead of a sheet transfer drum. The use of storage drums permits the employment of pincer-type gripper systems in the turning cylinder, which ensures that, throughout the entire turning operation, the trailing edge of the sheet is guided without being bent, even in the case of the thickest cardboard. Furthermore, the trailing edge of the sheet is exactly fed, clamped at the circumference and at the side, also in the case of different format sizes, until the pincer-type grippers of the turning drum have closed. Print-free areas are not required for conveying the sheet.

Guidance of the sheet by means of cylinders which have double or triple the diameter of the plate or blanket cylinders and the use of pincer-type grippers permits in-register printing of thick cardboard using both the single-side printing method as well as the first forme and perfector printing method at high press speeds. All printing units, even those accommodating parts of the turning apparatus, exhibit identical lower side parts.

To prevent smearing of the printed sides during perfector printing and, in accordance with another feature of the invention, at least the sheet-guiding surfaces of the turning cylinder as well as those of the directly following impression cylinders are provided with ink-repellent packings. These packings have a textured sheet-carrying surface and are formed of wear-resistant and chemically resistant material which is ink repellent, such as nickel or chrome.

In accordance with a concomitant feature of the invention, a drying device is located above the storage drum in the lower printing-unit half which is provided with parts of the turning apparatus. In such a case, it is unnecessary to provide ink-repellent packings on the outer cylindrical surfaces of the impression cylinders following the turning device. Of course, it is also possible, in order to prevent smearing, both to use the aforementioned ink repellent packings as well as to make use of a drying device.

Other features which are considered as characteristic for the invention are set forth in the appended claims.

Although the invention is illustrated and described herein as embodied in a sheet-fed rotary printing machine for single-side multicolor printing or perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic side elevational view of a four-color cardboard printing machine which is convertible to a two/two perfector printing machine i.e. such a printing machine which prints in two colors on either side of the sheet.

Referring now to the drawing, there is shown therein a cardboard printing machine having four printing units 1, 2, 3, 4 wherein a lower part of a printing unit 5 equipped with parts of a turning device is disposed between the first printing unit 1 and the pair of printing units 3 and 4. From a sheet feeder 6, sheets are fed via a feed table 7 to a feeding cylinder 8 of the printing unit 1. The feeding cylinder 8 accelerates the aligned sheet and transfers it to an impression cylinder 9 of the first printing unit 1. The sheet receives its first impression or print by means of a plate cylinder 10 and a rubber-covered or blanket cylinder 11 both of which have the same given diameter. Because the impression cylinder 9 has double the diameter of either the plate cylinder 10 or the blanket cylinder 11, it has two sheet-carrying surfaces. It transfers the printed sheet to the sheet transfer drum 12 of a second printing unit 2, the sheet transfer drum 12 having triple the diameter of either the plate cylinder 10 or the blanket cylinder 11. Then the impression cylinder 9 of the printing unit 2 receives the sheet. The second color is then printed on the sheet by means of the plate cylinder 10 and the rubber-covered cylinder or blanket 11 of the second printing unit 2.

The second printing unit 2 is followed by a lower part of a printing unit 5 which accommodates a sheet transfer drum 12 of so-called triple diameter and a storage drum 13 of so-called double diameter. The storage drum 13 is provided in the place of an impression cylinder 9 which normally appears in its location in the other printing units of the machine. An ultraviolet or infra-red drying device 14 may be provided above the storage drum 13. The twice-printed sheet is thus taken over by the sheet transfer drum 12 of the lower printing-unit part 5 and is fed to the storage drum 13 whereon the printed side of the sheet faces upwardly and can thus be dried by the drying device 14 as the sheet passes the latter. In the set-up of the cardboard printing machine illustrated in the FIGURE of the drawing, after the twice-printed and dried sheet has been transferred, and following previous smoothing in circumferential and lateral directions by rotary suction pads or suckers of the storage drum 13, the sheet is turned with the aid of the turning cylinder 15 which is housed in the third printing unit 3 in place of the sheet transfer drum 12 which customarily appears in its location in the other printing units of the machine. The turning cylinder 15 also has a so-called triple diameter and therefore is provided with three pincer-type gripper systems 16 symmetrically distributed over the circumference thereof. As shown in the FIGURE of the drawing, with the cardboard printing machine set for first forme and perfector printing, the pincer-type gripper system 16 grips the sheet by the trailing edge thereof and then guides it with the trailing edge first to the impression cylinder 9 of the printing unit 3. The first perfector impression or print is made thereat with the aid of the plate cylinder 10 and the rubber-covered or blanket cylinder 11 of the printing unit 3. The turning device of the invention is, thus, actually distributed over two normal lower printing-unit parts.

Because the fourth printing unit 4 has precisely the same construction as that of the second printing unit 2, having a sheet transfer drum 12 of triple diameter, an impression cylinder 9 of double diameter as well as a plate cylinder 10 and a rubber-covered or blanket cylinder 11 both of a given so-called single diameter, the sheet experiences its second perfector impression or printing in this fourth printing unit 4. Thereafter, the sheet which is printed twice on both sides thereof is transferred by the impression cylinder 9 to the delivery drum 17 which likewise has a double diameter. A chain delivery 18 thereupon feeds the printed sheet of paper or cardboard to the delivery pile 19 of the sheet delivery 20.

Should the sheet-supporting surfaces of the impression cylinders 9 of the two printing units 3 and 4 be provided with ink-repellent packings, a drying device need not be provided in the lower printing-unit part 5 because, due to the texture of the sheet-bearing surfaces as well as of the material thereof, the aforementioned packings prevent smearing of the freshly printed underside of the sheet. It is also possible, however, to prevent smearing absolutely by using both the drying device 14 as well as the aforementioned ink-repellent packings e.g. for papers with an especially smooth surface.

The advantage of the hereinafore-described cardboard printing machine is that, due to the large diameters of the sheet-guiding cylinders and drums, respectively, even thick cardboard can be transported free of trouble, reliably and without smearing. Due to the use of pincer-type grippers, it is possible to prevent the leading edge and the trailing edge, respectively, of the cardboard from bending. The use of a storage drum with an integrated format adjustment and with rotary suction pads or suckers at the trailing edge results in a far higher standard of quality than with the heretofore known turning devices. All in all, the multicolor printing machine which has been presented offers the possibility of processing papers as well as thicker cardboard in-register and smear-free throughout the entire format range even at high printing-machine speeds. It is evident that the lower printing-unit part 5 could also be provided between the printing units 1 and 2 or the printing units 3 and 4. It is of particular advantage that the side walls of the lower printing-unit parts of the printing units 2, 3, 4 and 5 are able to be of absolutely identical construction.

I claim:

1. Sheet-fed rotary printing machine which is capable of both single-side multicolor printing and perfector printing, said machine having an in-line type of construction with at least one sheet-turning device as well as devices for processing both papers and cardboard, said machine including respective printing units each having, in addition to a plate cylinder and a blanket cylinder of equal given diameter, an impression cylinder having a diameter at least double the given diameter and a sheet transfer drum, each of the printing units being formed of respective upper and lower parts, the lower parts of each of the printing units, except for a first printing unit thereof, being identical and including its respective impression cylinder, said machine also included an additional lower part identical with the identical lower printing-unit parts except that it includes a part of the turning device in the form of a storage drum in place of the respective impression cylinder, said additional lower part being located between an adjacent pair of the printing units, said storage drum being formed with at least two sheet-carrying surfaces, said additional lower part also including a sheet transfer drum with a diameter at least double the given diameter, said sheet transfer drum of said additional lower part being positioned on said additional lower part at a location which is identical to the position occupied by the sheet transfer drums on the lower parts of said printing units, the printing unit of said adjacent pair of printing units immediately following said additional lower part, in travel direction of a sheet through the printing machine, having, as another part of the turning device, a sheet transfer drum formed as a turning cylinder following said storage drum, said turning cylinder carrying at least two systems of pincer-type grippers.

2. Sheet-fed rotary printing machine according to claim 1, including a drying device located above said storage drum in said additional lower part located between said adjacent pair of printing units.

3. Sheet-fed rotary printing machine which is capable of both single-side multicolor printing and perfector printing, said machine having an in-line type of construction with at least one sheet-turning device as well as devices for processing both papers and cardboard, said machine including respective printing units each having, in addition to a plate cylinder and a blanket cylinder of equal given diameter, an impression cylinder having a diameter at least double the given diameter and a sheet transfer drum, each of the printing units being formed of respective upper and lower parts, the lower parts of each of the printing units, except for a first printing unit thereof, being identical and including its respective impression cylinder, said machine also including an additional lower part identical with the identical lower printing-unit parts except that it includes parts of the turning device and has a storage drum in place of the respective impression cylinder, said additional lower part being located between an adjacent pair of the printing units, said storage drum being formed with at least two sheet-carrying surfaces, said additional lower part also including a sheet transfer drum with a diameter at least double the given diameter, said sheet transfer drum of said additional lower part being positioned on said additional lower part at a location which is identical to the position occupied by the sheet transfer drums on the lower parts of said printing units, the printing unit of said adjacent pair of printing units immediately following said additional lower part, in travel direction of a sheet through the printing machine, having a sheet transfer drum formed as a turning cylinder following said storage drum, said turning cylinder carrying at least two systems of pincer-type grippers, the impression cylinder directly following said turning cylinder in said sheet travel direction being formed with sheet-guiding surfaces, at least said sheet-guiding surfaces having ink-repellent packings.

* * * * *